United States Patent [19]

Chlystun

[11] 4,139,129

[45] Feb. 13, 1979

[54] CONTAINER WITH NESTABLE POURING SPOUT

[76] Inventor: Walter K. Chlystun, 327 St. James Dr., Spartanburg, S.C. 29301

[21] Appl. No.: 725,933

[22] Filed: Sep. 23, 1976

Related U.S. Application Data

[63] Continuation-in-part of Ser. No. 638,618, Dec. 8, 1975, Pat. No. 4,027,811.

[51] Int. Cl.[2] ..... B67D 3/00

[52] U.S. Cl. ..... 222/529

[58] Field of Search ..... 222/529, 530, 534, 535, 222/541, 517; 215/32, 250, 253; 229/7

[56] References Cited

U.S. PATENT DOCUMENTS

| | | | |
|---|---|---|---|
| 2,898,018 | 8/1959 | Borah | 222/529 |
| 3,856,187 | 12/1974 | Chlystun | 222/529 |
| 3,957,169 | 5/1976 | Coursant | 215/253 |
| 3,986,646 | 10/1976 | Strub | 222/529 |
| 3,998,354 | 12/1976 | Song | 222/541 X |
| 4,010,875 | 3/1977 | Babiol | 222/517 |
| 4,027,811 | 6/1977 | Chlystun | 222/529 |

*Primary Examiner*—Joseph F. Peters, Jr.
*Assistant Examiner*—Norman L. Stack, Jr.
*Attorney, Agent, or Firm*—Wellington M. Manning, Jr.; Luke J. Wilburn, Jr.

[57] ABSTRACT

A container is disclosed having a collapsible pouring spout in a top portion thereof. The pouring spout is nestable within the container in a preferred arrangement, and the container walls, container top and pouring spout are of integral or unitary construction having been blow molded. The spout has a partially removeable cover secured thereto in unitary fashion with a weakened tear line extending partially therearound, and the cover has an element thereon for withdrawal of the spout and partial removal of the cover. Additionally, a vent structure may be employed to assist in withdrawal of the spout from its nested position. Upon lifting of the withdrawal structure, the vent structure opens first. Thereafter, at the top of the spout withdrawal, the cover is partially removed along the tear line which terminates at a cover hinge means.

4 Claims, 3 Drawing Figures

CONTAINER WITH NESTABLE POURING SPOUT

CROSS REFERENCE TO RELATED APPLICATION

This is a continuation-in-part of application Ser. No. 638,618, filed Dec. 8, 1975, now U.S. Pat. No. 4,027,811.

BACKGROUND OF THE INVENTION

Containers with integral pouring spouts have been developed heretofore as evidenced by the Chlystun patents, 3,690,522 and 3,856,187, directed to same. Likewise, other containers have been provided where pouring spouts are reversible so as to be disposed inside the container, collapse into the container in some fashion, screw onto the container or the like. In general, with the advent of blow molding and with further refinements of tool making capabilities, a container having a pouring spout may be produced such that the spout can be everted to a nestable postion within the container. Opposite ends of the container are then coplanar with respect to the edges and permit ease of stacking, handling and the like. Furthermore, it is quite desirable in such containers that the pouring spout be withdrawable to a pouring position and that the spout be opened for dispensing of the contents from the container.

Containers such as mentioned above, are primarily intended for use for storing and dispensing oil, hazardous chemicals, fuels and various household and industrial compositions. An independent opener and/or spout is no longer required for such use and containers according to the types following the teachings of the present invention are quite suitable for sale through vending machines at self-service gasoline stations, or other locations with the containers having motor oil or other petroleum products therein that might be found in these location outlets. In addition to the advantages supplied by the lack of a need of an opener, pouring spout or the like, containers according to the present invention have been found to be more durable, quickly filled on existing packaging equipment, and less likely to leak or be ruptured during normal handling and use. The old problem of "leakers", a hazard to outlets for motor oil and the like has been, for the most part, obviated. Containers according to the present invention may now be placed on a store shelf where they can remain for a long period of time without any real danger of leakage of the contents from the container.

The present invention thus provides a further improved dispensing container where a cover is provided that is partially removed from the pouring spout to permit dispensing, but which remains integral with the spout and may be used to reclose the spout if desired. The prior art does not teach or suggest the inventive concept of the present invention.

SUMMARY OF THE INVENTION

It is an object of the present invention to provide an improved container with a collapsible pouring spout.

Another object of the present invention is to provide an improved container having a collapsible pouring spout where a cover for the spout is only partially removeable therefrom to permit dispensing of the contents of the container.

Still another object of the present invention is to provide an improved blow molded container having a pouring spout produced integral therewith and a self producing vent means thereon and a cover that is only partially removeable therefrom.

Yet another object of the present invention is to provide an improved blow molded container with a recloseable or resealable collapsible pouring spout having improved opening means therefor.

Generally speaking, the container of the present invention comprises a container body; a top secured to said body; a pouring spout secured to said top and being nestable within said container body; a cover secured to said pouring spout, said cover having spout withdrawal means therewith; a weakened tear area located adjacent the juncture between said cover and said spout for a portion of the circumference of the spout only and permitting said cover to be partially removed from said spout only; and a hinge means located between said cover and said spout, said weakened tear area terminating at said hinge means, whereby said cover is held on said spout after said spout is opened.

More specifically, the container of the present invention in a preferred embodiment has a nestable spout that is integral with the container body and top, said spout being in a nested position when the container is full and withdrawable to a pouring position. During withdrawal of the spout, it is preferred to provide a vent to ensure proper withdrawal of the spout. A cover provided atop the pouring spout is partially separable therefrom along a weakened tear area which terminates at a cover hinge means located between said cover and said spout. Adjacent the weakened tear area, the vent means may also be provided that preferably extends longitudinally along the dispensing spout and is secured to an underside of a spout withdrawal means which forms a part of said cover. Initial lifting of the withdrawal means causes rupture of the vent means, whereby a vent is produced at the forward end of the spout. Continued pulling of the tab will thereafter cause the weakened tear area to also rupture to the beginning of the hinge means to facilitate partial removal of the cover from the end of the spout. The cover can then be bent around the hinge means to permit dispensing of the contents of the container. Likewise, the cover may be severed along a line terminating at the hinge means for partial removal of the cover.

In a most preferred embodiment, the container of the present invention is integral insofar as the container body, container top, spout, cover and withdrawal means are concerned, in that, the preferred method of manufacture is by a blow molding technique. Blow molding is well known to those skilled in the art where a pliable plastic material in parison form is clamped in between mold parts around a blow pin, or a blow needle is injected therethrough. An expansion fluid is then expeled into the inside of the parison and expands the parison into conformity with the mold cavities to produce the container.

DESCRIPTION OF THE PREFERRED EMBODIMENTS

Figure 1:
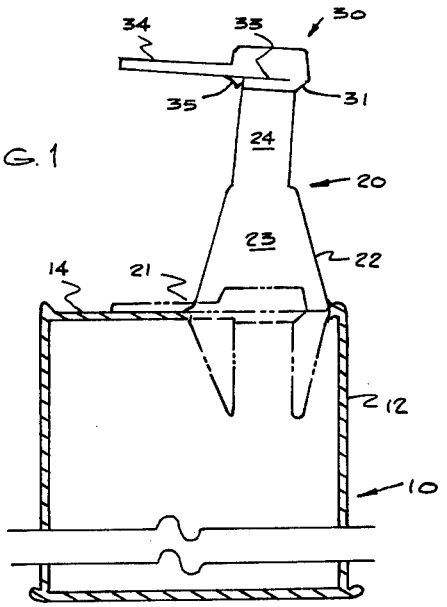
FIG. 1 is a partial cross sectional view of a container according to the teachings of the present invention.
Figure 2:
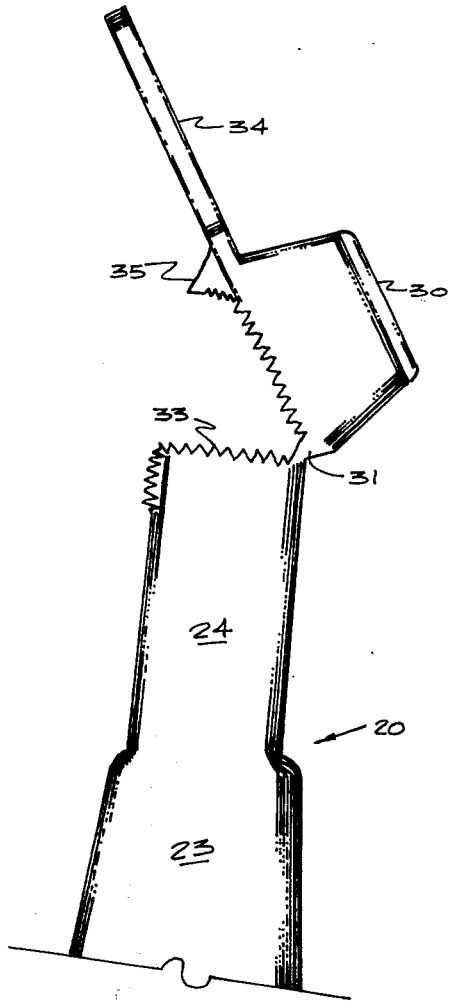
FIG. 2 is a side elevational view of a spout as shown in FIG. 1 with the cover partially removed therefrom.

In FIGS. 1 and 2, a container generally indicated as 10 is provided having a side wall 12 that is generally cylindrical in shape. A top 14 is provided that is secured to side wall 12 and preferably is of unitary construction therewith. Secured to top wall 14 is a spout generally indicated as 20 with is provided to permit dispensing of the contents from within the container. As shown in FIGS. 1 and 2, spout 20 is in an extended position preparatory to dispensing of the contents of the container. As the container is filled, the spout is presented in a nested position within the container as illustrated in phantom in FIG. 1.

Spout 20 as shown in the drawings has a radius 21 at the juncture with top 14 where an inward bend is produced during collapse of the spout into the container. Spout 20 has an elongated side wall 22 which has one or more sections 23 and 24 as shown in FIG. 1. At the tip of the forward end of spout section 24 is a cover generally indicated as 30. Cover 30 may be simply a cover member for the spout that is partially removed therefrom to permit the contents of the container to pass through the spout during pouring or may be provided with reclose features as particularly described hereinafter.

Cover 30 in its securement to spout 20 may simply be an extension thereof so as to seal the forward end of spout 20 while having a hinge means 31 represented by a thickened wall section or the like between cover 30 and spout wall 22. In a preferred arrangement, a weakened tear area 33 is provided adjacent forward end 24 of spout 20 and cover 30 that extends partially around spout 20, terminating at hinge means 31. As further shown, the cover 30 may include a withdrawal means 34. Withdrawal means 34 may be secured to cover 30 and is lifted to withdraw spout 20 in a convenient fashion from its nested position in container 10. Withdrawal means 34 is preferably a tab that is secured to and extends from cover 30, having a vent means 35 on an underside thereof that is secured to side wall 22 of spout 20. Upon lifting withdrawal means 34, vent means 35 ruptures to produce an opening in spout 20 to facilitate withdrawal. Continued lifting would then cause rupture along tear area 33 to hinge means 31 to partially remove cover 30 from spout 20.

Figure 3:
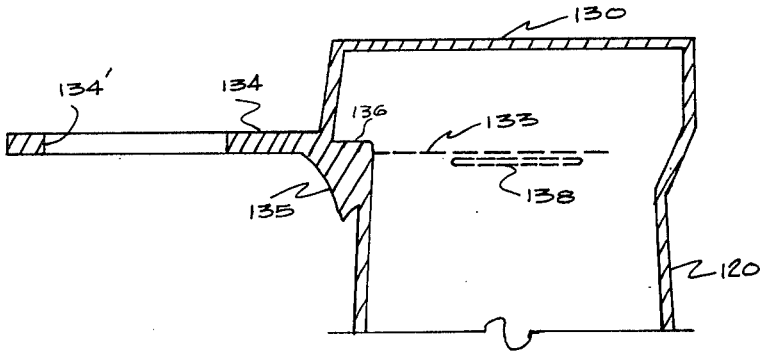
FIG. 3 is a further cross sectional view of a spout for the container as shown in FIG. 1 to illustrate a further embodiment of same.

As shown in FIG. 3, a cover 130 may be provided with a withdrawal means 134 having an opening 134' therein which may be employed as a means for grasping withdrawal means 134 for upward lifting to withdraw spout 120 from its nested position. Likewise, cover 130 may be provided with a shoulder 136 that extends at least partially therearound adjacent tear line 133. Spout 120 would be provided with a bead 138 adjacent an opposite side of tear line 133. After opening of spout 120 by upward pulling of withdrawal means 134, producing a vent at vent means 135 partial removal of cover 130 along tear line 133 to hinge means 131 will occur. Cover 130 could then be replaced over spout 120, with shoulder 136 passing over bead 138 to reclose spout 120.

Having described the present invention in detail, it is obvious that one skilled in the art will be able to make variations and modifications thereto without departing from the scope of the invention. Accordingly, the scope of the present invention should be determined only by the claims appended hereto.

What is claimed is:

1. A dispensing container comprising:

(a) a container body;

(b) a collapsible dispensing spout secured to said body and being nestable within said container;

(c) a cover of unitary construction with a top of said spout to initially seal said spout, said cover including spout withdrawal means of unitary construction therewith and extending outwardly therefrom in a direction generally transverse to said spout in a withdrawn position, said spout and said cover having a weakened tear area located at the junction therebetween and extending only partially around said spout;

(d) hinge means located at the junction between said spout and said cover and being of unitary construction with said cover and said spout, said weakened tear area extending around said spout to said hinge means; and (e) vent producing means secured between an underside of said withdrawal means and a side wall of said spout.

2. A dispensing container as defined in claim 1 wherein said hinge means is a thickened wall section with respect to said tear area.

3. A dispensing container as defined in claim 1 wherein said cover has an inwardly projecting shoulder on the inside of same and said spout has at least one outwardly projecting element thereon adjacent said tear area, whereby said cover can reclose said spout after partial removal therefrom.

4. A dispensing container as defined in claim 1 wherein the dispensing spout is of unitary construction with said container body.

* * * * *